United States Patent [19]

Geerling

[11] 4,346,268

[45] Aug. 24, 1982

[54] AUTOMATIC AUDIOLOGICAL ANALYZER

[76] Inventor: Leonardus J. Geerling, Rte. 2, Box 947, Hillsboro, Oreg. 97123

[21] Appl. No.: 229,887

[22] Filed: Jan. 30, 1981

[51] Int. Cl.[3] ..... H04R 29/00

[52] U.S. Cl. ..... 179/175.1 A; 179/107 R

[58] Field of Search ..... 179/175, 175.1 A, 175.2 R, 179/175.2 C, 107 R, 107 E, 175.1 R, 1 MN, 1 N, 1 D, 1 G, 1 GP, 1 P, 1 SA; 364/579

[56] References Cited

U.S. PATENT DOCUMENTS

| | | | |
|---|---|---|---|
| 3,922,506 | 11/1975 | Frye | 179/175.1 A |
| 4,065,647 | 12/1977 | Frye et al. | 179/175.1 A |
| 4,161,029 | 7/1979 | Frye et al. | 364/579 |
| 4,191,864 | 3/1980 | Sopher | 179/175.1 A |
| 4,209,672 | 6/1980 | Nitta et al. | 179/175.1 A |

FOREIGN PATENT DOCUMENTS 720821 3/1980 U.S.S.R. .

*Primary Examiner*—Thomas A. Robinson
*Attorney, Agent, or Firm*—Adrian J. La Rue

[57] ABSTRACT

An acoustical analyzer system analyzes the operating characteristics of an acoustical device by operator selection of frequencies and amplitudes of test tone signals, automatically generating test tone signals representative of the selected frequencies and amplitudes and driving the acoustical device thereby to produce output signals from the device, sampling the output signals, generating sampled signals representative of the output signals, applying Fast Fourier Transform analysis to the sampled signals to generate readout signals therefrom and operating readout means via the readout signals to display the operating characteristics of the device.

24 Claims, 4 Drawing Figures

AUTOMATIC AUDIOLOGICAL ANALYZER

BACKGROUND OF INVENTION

U.S. Pat. No. 3,922,506 discloses an acoustical testing system for testing acoustical devices by generation of test tone signals at selected frequencies and amplitudes which are transmitted to an acoustical device under test. The output signals, from the device under test, are automatically processed to actuate readout devices that simultaneously indicate, in digital format, sound pressure level in dB's and percent of harmonic distortion of the signals from the device under test. The selection of the frequencies and the amplitude is done manually.

U.S. Pat. No. 4,065,647 is an improvement over the invention in U.S. Pat. No. 3,922,506 by the use of a microprocessor to automatically generate test tone signals at selected frequencies and amplitudes to drive an audiological device under test and then automatically process the output signals from the device to operate readout means to indicate digital information of the sound pressure level in dB's and percent of harmonic distortion of the output signals from the device under test.

Both the systems in the U.S. Pat. Nos. 3,922,506 and 4,065,647 use standard discrete filter networks and RMS detectors to process the signals to provide the sound pressure level and percent of harmonic distortion as digital readout information.

SUMMARY OF THE INVENTION

The present invention is related to audiological analyzer systems and more particularly to automatic audiological analyzer systems.

The present invention is realized by the use of a program-controlled central processing unit when activated to generate test tone signals of selected frequencies and amplitudes to an acoustical device under test, sampling the output signals from the device, generating sampled signals representative of the output signals, applying Fast Fourier Transform analysis to the sampled signals, generating readout signals formulated from the Fast Fourier Transform analysis and operating readout means via the readout signals to display operating characteristics of the device under test.

The present invention substantially reduces circuitry by not using discrete filter circuits and detector circuits and this enables all the circuits of the system to be on one board, renders the system to be less expensive and to be formed into a portable device.

An object of the present invention is to provide an automatic acoustical analyzer system that automatically processes output signals from an acoustical device under test.

Another object of the present invention is to provide an automatic acoustical analyzer system that automatically generates sine wave test tone signals to a device under test when square wave signals and sine wave test tone signals are coincident.

A further object of the present invention is the provision of an automatic acoustical analyzer system that automatically samples output signals from an acoustical device under test and applies Fast Fourier Transform analysis thereto to generate readout signals therefrom.

An additional object of the present invention is the provision of an automatic acoustical analyzer system that will simultaneously display sound pressure level and percent of harmonic distortion information of output signals from an acoustical device under test.

Still a further object of the present invention is to provide an automatic acoustical analyzer system that will automatically level the sound chamber prior to testing an acoustical device.

A still additional object of the present invention is the provision of an automatic acoustical analyzer system that reduces circuitry to automatically generate test tone signals at selected frequencies and amplitudes to drive an acoustical device and automatically samples and analyzes output signals from the device to display information of the operating characteristics of the device.

These and other objects and advantages of the present invention will become apparent from the following description when taken in conjunction with the accompanying drawings. It is to be understood that variations of the present invention can be made without departing from the scope of the invention as disclosed herein.

DETAILED DESCRIPTION OF THE INVENTION

Figures 1, 3A:
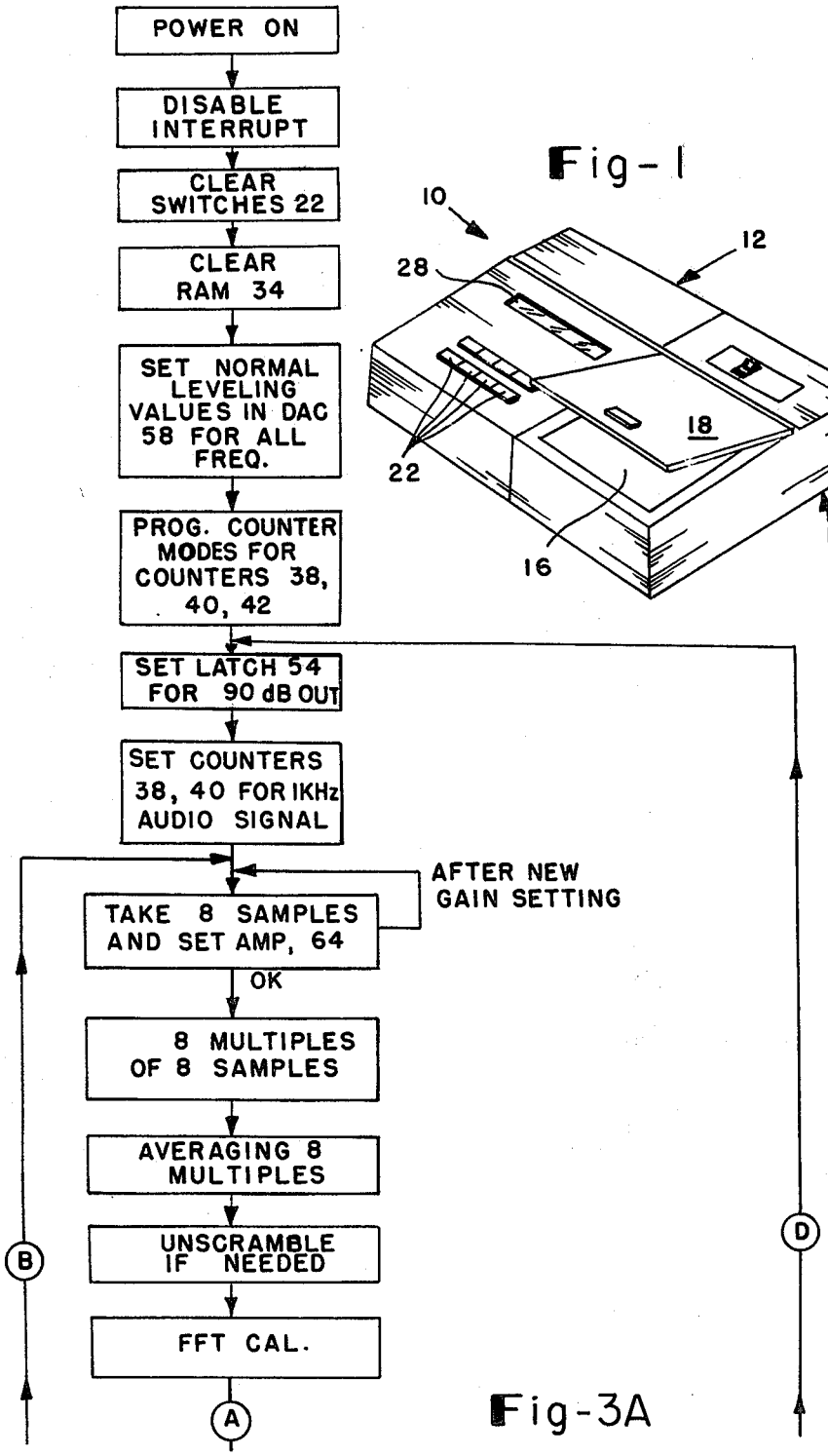
FIG. 1 is a perspective view of the outward appearance of the automatic acoustical analyzer.
FIGS. 3A and 3B are a flow diagram of the operation of the computer.

FIG. 1 illustrates an automatic acoustical analyzer 10 which contains a module 12 in which the electronic circuitry is housed and another module 14 in which a sound chamber 16 is located; both modules being mounted onto a base member (not shown). A lid 18 is hingedly mounted on module 14 to close sound chamber 16 when tests are conducted on acoustical devices such as hearing aids or the like.

Figure 2:
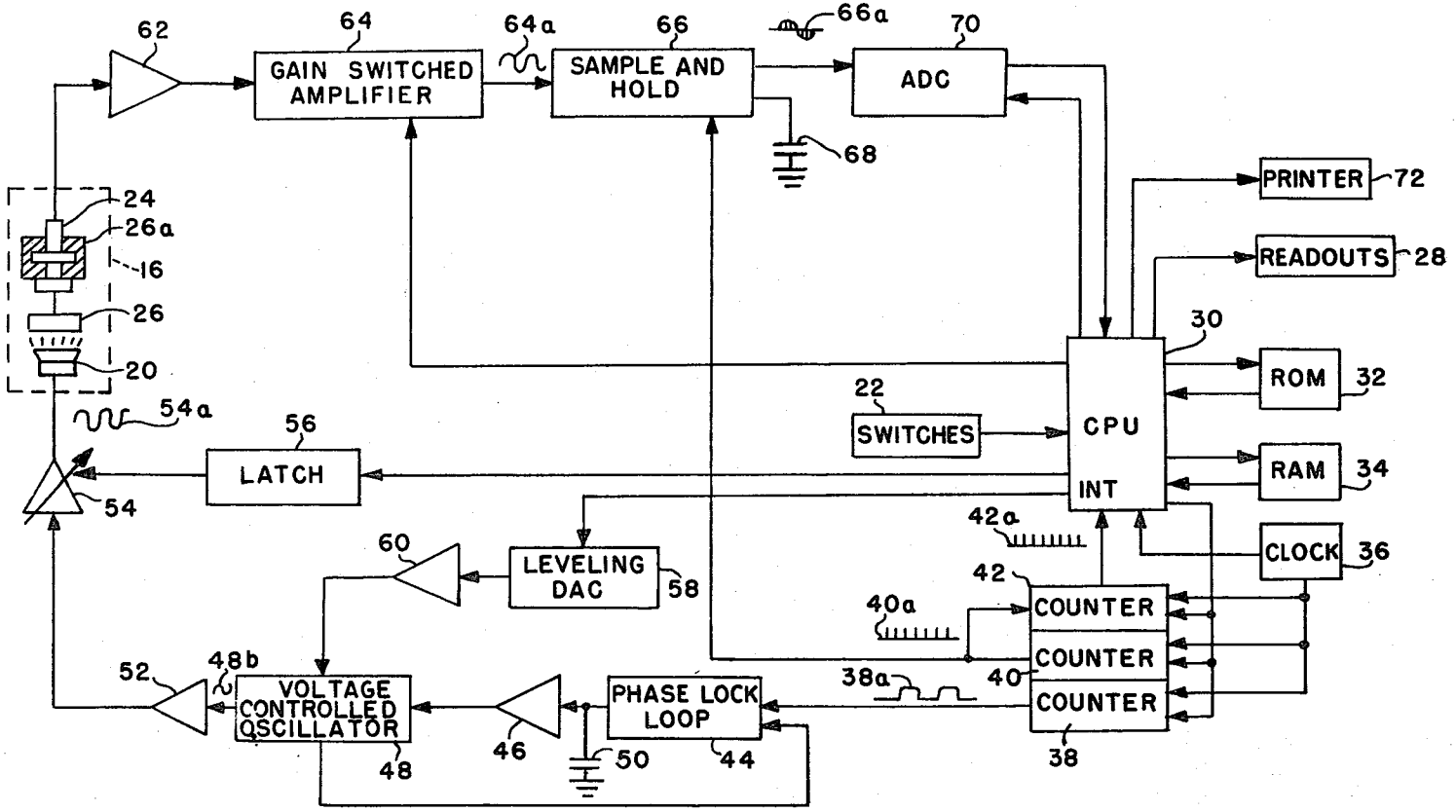
FIG. 2 is a block diagram of the automatic acoustical analyzer.

Sound chamber 16 and lid 18 are acoustically insulated to define a sound pressure chamber that is anechoically acceptable to test acoustical devices. A speaker 20, FIG. 2, is mounted in sound chamber 16 to automatically generate pure tone test signals at selected frequencies and amplitudes when switches 22 are operated in electronic circuitry module 12. A microphone 24, FIG. 2, is also used in sound chamber 16 and it generates output signals representative of the test tone signals from speaker 20 or from an acoustical device 26 under test in the sound chamber 16 which output signals are automatically processed by the electronic circuitry to operate readouts 28 to display information of the condition of the sound chamber or the operating characteristics of the device under test.

The electronic circuitry for the analyzer system is illustrated by the block diagram of FIG. 2. Switches 22 comprise conventional push button switches that select the amplitude and frequency of a test tone signal, levelling of the sound chamber and percent of harmonic distortion of the output signals from device 26 regarding second, third and total harmonic distortion.

The operation of switches 22 causes CPU 30, which is a conventional microprocessor such as a Z80 which is manufactured by Zilog, Inc. to automatically control operation of the electronic circuitry under program control as hereinafter described.

ROM 32 is a conventional circuit and is operationally connected to CPU 30 and contains all the programs for operation of analyzer 10. RAM 34 is of conventional design, is operationally connected to CPU 30 and is used for temporary storage of data obtained by the program. Clock 36 is a conventional circuit which comprises a high frequency crystal-controlled oscillator (e.g. 2 MHz) that is connected to CPU 30 and transmits internal timing signals thereto. CPU 30, ROM 32, RAM 34 and clock 36 form a digital computer which automatically processes electrical signals from electronic circuits and operates these electronic circuits as required by the program.

Programmable counters 38, 40 and 42 are of conventional design and they receive output signals from CPU 30 and clock 36. Counter 38 is programmed by CPU 30 to generate an output signal 38*a* having a symmetrical square wave configuration of a predetermined frequency. Counter 40 is also programmed by CPU 30 to generate narrow output pulses 40*a* of a predetermined frequency of eight or less pulses per cycle of waveform 38*a*. The frequencies of counters 38 and 40 can be controlled independently by CPU 30. Counter 42 also receives an input from counter 40 to generate interrupt signals 42*a* transmitted to CPU 30. Under normal conditions, the interrupt signals 42*a* will not interrupt operation of CPU 30 except at predetermined times determined by the program in ROM 32.

Output signals 38*a* are transmitted to phase lock loop circuit 44 of conventional design which also receives a feedback signal 48*a* from the output of a conventional voltage-controlled oscillator 48 which is of the same frequency as the output sine wave signal 48*b* of oscillator 48. Voltage-controlled oscillator 48 will generate output sine wave signals of a frequency based upon the DC level being applied thereto from buffer amplifier 46. The output of phase lock loop circuit 44 is a DC level signal which is connected via buffer amplifier 46 to oscillator 48. The amplitude of the DC level signal is established by the frequency and phase comparison between signals 38*a* and 48*a*. Thus, when signals 38*a* and 48*a* are coincident, signal 48*b* will have the same frequency as that of 38*b*. Capacitor 50 stabilizes the output from phase lock loop circuit 44 and buffer amplifier 46 reduces the high impedance of the output from phase lock loop circuit 44 and capacitor 50 so oscillator 48 can be operated.

Output signal 48*b* is passed through buffer amplifier 52 to decrease the output impedance of the signal from oscillator 48 to generate adequate drive signals to operate variable gain speaker amplifier 54 of conventional design. The amplitude of output signals 54*a* from amplifier 54 are controlled by CPU 30 via latch 56 of conventional design. Thus, sine wave output signals 54*a* from amplifer 54 have a predetermined frequency and amplitude controlled by the user via switches 22 and CPU 30 to operate speaker 20 to generate test tone signals in sound chamber 16. The amplitude levels of the test tone signals extend from 50 dB to 100 dB at 5 dB increments and an off position. The frequency range of the test tone signals is 250–6300 Hz in one sixth octaves.

Additional amplitude control for each frequency is available via activation of one of switches 22 to operate levelling digital to analog converter circuit 58 and buffer amplifier 60 to operate voltage-controlled oscillator 48. Levelling digital to analog converter circuit 58 is of conventional design and is under control of CPU 30 and its purpose is to correct for irregularities in sound chamber 16.

After levelling of the sound chamber has taken place, acoustical device 26, which in this case can be a hearing aid, is coupled to a standard 2 cc coupler 26*a* and in which microphone 24 is placed.

Microphone 24 is connected to low noise microphone amplifier 62 and transmits thereto output signals from speaker 20 during the levelling operation or from acoustical device 26. The output signals from amplifier 62 are transmitted to gain switched amplifier 64 utilizing conventional companding DAC and operational amplifier circuits. The gain of amplifier 64 is controlled by CPU 30 to generate an output signal 64*a* of which the peak value is always between two predetermined voltage levels, the lower voltage level being about half the upper level and the upper voltage level not exceeding maximum circuit limitations. This enables more accurate operation.

The output sine wave signal 64*a* from amplifier 64 is transmitted to conventional sample and hold circuit 66 which also simultaneously receives signals 40*a* from counter 40. Counter 40 determines when samples of sine wave signal 64*a* from amplifier 64 are taken to generate output signal 66*a* and the amplitude level at which the sine wave signal 64*a* is sampled will be stored in capacitor 68 until the next sample is taken.

During the time that an amplitude level of the sampled signal is stored in capacitor 68, CPU 30 activates analog to digital converter circuit 70, reads its result and stores such result in RAM 34.

Typically in one mode of operation, eight samples or multiples thereof are taken of the output signal 64*a* from amplifier 64 by sample and hold circuit 66, converted by converter 70 to digital signals representative of the amplitude of the sampled signal and these digital signals are stored in RAM 34. The stored digital signals are processed by CPU 30 by utilization of conventionally-known Fast Fourier Transform analysis to generate readout signals that operate readouts 28 to display sound pressure level in dB's of the fundamental frequency and percent of distortion for second, third or total harmonics thereof. If desired, a conventional printer 72 can also be operated by CPU 30 to print out the data displayed by readouts 28 and other desirable alpha numeric information.

Counter 40 determines when sample and hold circuit 66 operates to take samples of signal 64*a* via signals 40*a*. When CPU 30 is ready to operate on the sampled signal 66*a* determined by the program contained in ROM 32, the program will enable the CPU interrupt input and the first negative transition of signal 42*a* will jump to the program in ROM 32 to start converter 70 to process that sampled signal 66*a*. At the same time, the program will disable the interrupt input. When converter 70 is finished processing signal 66*a* a short time later, CPU 30 will store this data in RAM 34. At least seven more samples in this manner will be processed. Normally, eight samples are taken sequentially during one cycle of signal 64*a*.

Other modes of operation are also utilized which comprise taking eight samples or multiples thereof of signal 64*a* during more than one cycle or multiples thereof which are stored. Thereafter, the stored samples are unscrambled and placed in proper sequence. Further processing, including Fast Fourier Transform analysis of the stored samples, takes place prior to display.

When multiples of eight samples are taken of signal 64*a*, averaging techniques thereof are used to increase accuracy and more stable display of the information.

Figure 3B:
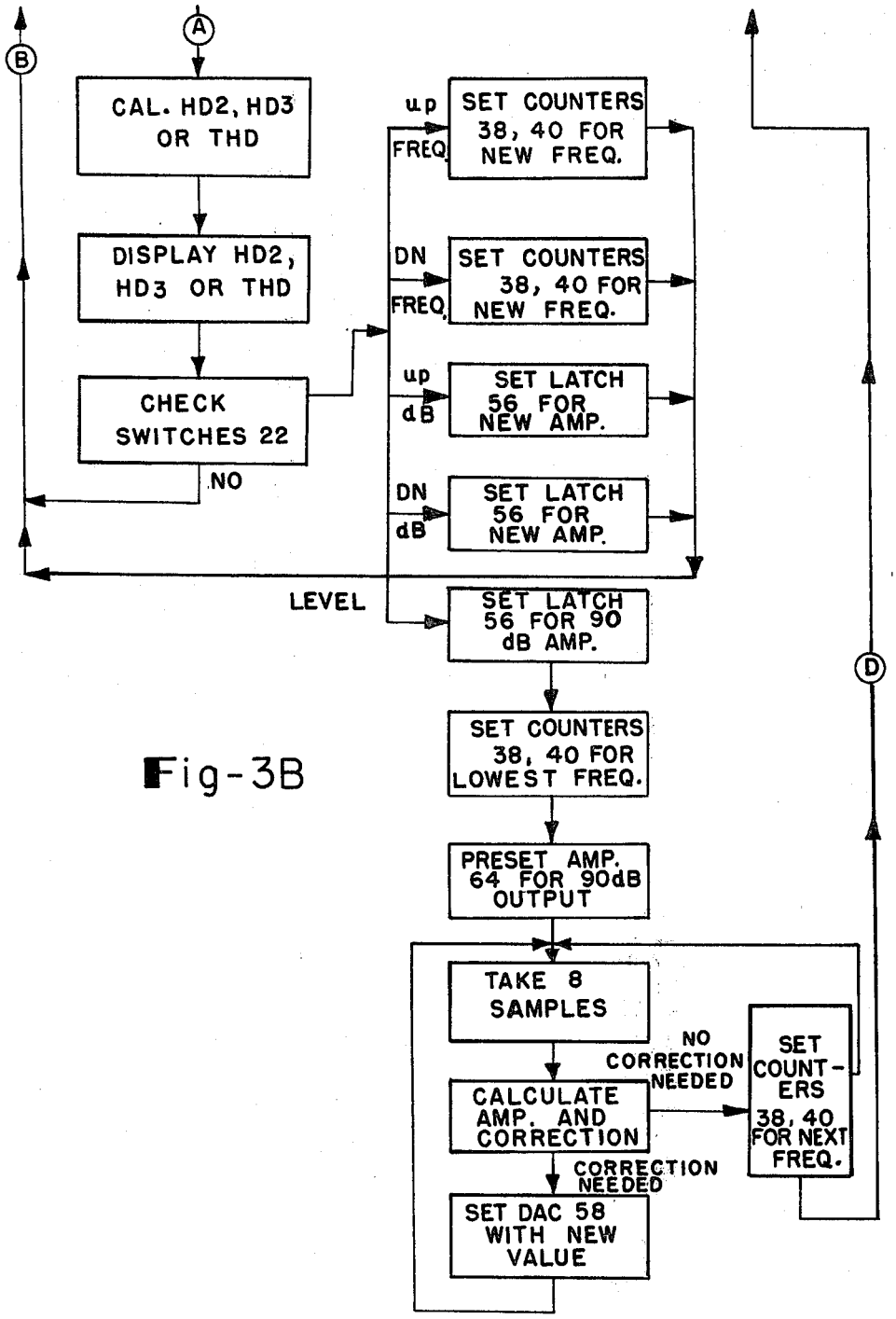

FIGS. 3A and 3B illustrate the flow diagram for operation of the computer to automatically generate test tone signals of selected frequency and amplitude, to drive an acoustical device under test, automatically sample the output signals from the device under test, store the sampled signals and apply Fast Fourier Transform analysis to the stored signals to develop display-operating signals to operate display means to display operating characteristics of the device under test.

Although the invention has been described as hereinbefore set forth, it will be appreciated that various changes and modifications may be made therein without departing from the scope of the invention as claimed in the accompanying claims.

The invention is claimed in accordance with the following:

1. An acoustical analyzer system for testing acoustical devices comprising:

means for generating operating signals having a predetermined frequency;

means for receiving said operating signals and generating voltage signals;

means for receiving said voltage signals and generating feedback signals to said means for generating said voltage signals, said means for receiving said voltage signals generating test signals having the same frequency as the frequency of said operating signals and said feedback signals when they are in coincidence;

means for receiving said test signals and generating test tone signals having a predetermined frequency and amplitude for driving a device under test, which generates output signals;

means receiving said output signals and sampling said output signals to generate sampled signals at amplitude levels of said output signals;

means for storing the amplitude levels;

means for converting said amplitude levels to digital signals and storing said digital signals; and means for processing said digital signals to generate utilization signals.

2. An acoustical analyzer system according to claim 1 wherein said means for generating operating signals comprises counter means.

3. An acoustical analyzer system according to claim 2 wherein said counter means generates an interrupt signal to cause said converting means to commence operation to create the digital signals and storage thereof.

4. An acoustical analyzer system according to claim 1 wherein said means for generating voltage signals comprises phase lock loop circuit means.

5. An acoustical analyzer system according to claim 1 wherein said means for generating feedback signals and test signals comprises voltage-controlled oscillator means.

6. An acoustical analyzer system according to claim 1 wherein said means for generating test tone signals comprises variable gain amplifier means.

7. An acoustical analyzer system according to claim 1 wherein display means receive said utilization signals to display operating characteristics of the device under test.

8. An acoustical analyzer system according to claim 1 wherein printer means receive said utilization signals to print operating characteristics of the device under test.

9. An acoustical analyzer system according to claim 1 wherein said means for receiving said voltage signals includes levelling means for automatically generating a series of test signals at specified frequencies.

10. An acoustical analyzer system for testing acoustical devices comprising:

means for selecting a test tone signal having a specified frequency and amplitude;

test tone signal generator means receiving said test tone signal to automatically generate sinusoidal test tone signals representative of said test tone signal at said specified frequency and amplitude for exciting an acoustical device to generate output signals therefrom;

processing means receiving the output signals to automatically process the output signals by generating sampled signals of the output signals;

means for automatically transforming said sampled signals to utilization operating signals;

means for storing said utilization operating signals; and utilization means receiving said utilization operating signals to operate said utilization means.

11. An acoustical analyzer system according to claim 10 wherein said means for selecting comprises switch means.

12. An acoustical analyzer system according to claim 10 wherein said test tone signal generator means comprises counter means for generating counter signals, phase lock loop circuit means for receiving said counter signals and generating voltage signal means, voltage-controlled oscillator means for receiving said voltage signal means and generating test signal means and feedback signals, said feedback signals being received by said phase lock loop circuit means and said test signal means having the same frequency as said counter signals when said counter signals and said feedback signals are in coincidence.

13. An acoustical analyzer system according to claim 12 wherein said test tone signal generator means further comprises gain amplifier means for receiving said test signal means and generating test tone signals of a predetermined frequency and amplitude for exciting the acoustical device.

14. An acoustical analyzer system according to claim 12 wherein said test tone signal generator means comprises levelling means connected to said voltage-controlled oscillator means for automatically controlling said voltage-controlled oscillator means to generate a series of test signal means at specified frequencies.

15. An acoustical analyzer system according to claim 10 wherein said processing means comprises gain-switched amplifier means for receiving said output signals, sampling means for sampling said output signals to generate said sampled signals and holding means for storing said sampled signals.

16. An acoustical analyzer system according to claim 10 wherein said automatic transforming means comprises analog to digital converter means for converting said stored sampled signals to digital signals which are transformed by Fast Fourier Transform analysis to said utilization operating signals.

17. An acoustical analyzer system according to claim 10 wherein said storing means comprises RAM means.

18. An acoustical analyzer system according to claim 10 wherein said utilization means comprises display means for displaying operating characteristics of the acoustical device.

19. An acoustical analyzer system according to claim 10 wherein said utilization means comprises printer means for printing operating characteristics of the acoustical device.

20. An acoustical analyzer system according to claim 10 wherein said test tone signal generator means generates an interrupt signal to cause said automatic transforming means to commence operation to create said utilization operating signals and storage thereof.

21. A method of automatically testing the operating characteristics of an acoustical device, comprising the steps of:

selecting frequencies and amplitudes of test tone signals to be applied to an acoustical device to be tested;

automatically generating sinusoidal test tone signals representative of the selected frequencies and amplitudes of the test tone signals;

applying said sinusoidal test tone signals to the acoustical device thereby exciting the acoustical device to produce output signals from the device;

generating sampled signals representative of the output signals;

applying Fast Fourier Transform analysis to said sampled signals to generate utilization signals; and operating utilization means by said utilization signals to provide operating characteristics of the device.

22. The method of claim 21 wherein the step of automatically generating comprises initiating counter means to generate the test tone signals, changing the test tone signals to voltage signal means, generating feedback signals, and, when said feedback signals are coincidental with said test tone signals, generating said sinusoidal test tone signals.

23. The method of claim 21 further comprising the steps of storing the sampled signals and generating digital signals representative of said sampled signals.

24. The method of claim 21 further comprising the steps of generating an interrupt signal when said test tone signals are generated to cause generation of said utilization signals.

* * * * *